US007264707B1

(12) United States Patent
Furman et al.

(10) Patent No.: US 7,264,707 B1
(45) Date of Patent: Sep. 4, 2007

(54) CORROSION INHIBITOR MATERIALS FOR USE IN COMBINATION WITH CATHODIC PROTECTORS IN METALLIC STRUCTURES

(75) Inventors: Alla Furman, Shoreview, MN (US); Margarita Kharshan, Little Canada, MN (US); Boris A. Miksic, North Oaks, MN (US)

(73) Assignee: Cortec Corporation, St. Paul, MN (US)

( * ) Notice: Subject to any disclaimer, the term of this patent is extended or adjusted under 35 U.S.C. 154(b) by 43 days.

(21) Appl. No.: 11/240,615

(22) Filed: Sep. 30, 2005

(51) Int. Cl.
*C23F 13/06* (2006.01)

(52) U.S. Cl. ..... 205/730; 205/724; 205/740

(58) Field of Classification Search ..... 205/724, 205/730, 740
See application file for complete search history.

(56) References Cited

U.S. PATENT DOCUMENTS 5,427,819 A 6/1995 Weyers et al.
5,561,173 A 10/1996 Dry
5,575,841 A 11/1996 Dry
5,597,514 A 1/1997 Miksic et al.
5,660,624 A 8/1997 Dry
5,750,053 A 5/1998 Miksic et al.
6,028,160 A * 2/2000 Chandler et al. ..... 528/176
6,054,512 A 4/2000 Nelson et al.
6,075,072 A 6/2000 Guilbert et al.
6,617,415 B1 * 9/2003 Miksic et al. ..... 528/190
6,764,615 B2 7/2004 Miksic et al.
2004/0259447 A1 * 12/2004 Elkouh et al. ..... 442/121

OTHER PUBLICATIONS

Storage Tank Bottom Protection Using Volatile Corrosion Inhibitors, Ashish Gandhi, Supplement to Materials Performance, Jan. 2001.

* cited by examiner

*Primary Examiner*—Bruce F. Bell
(74) *Attorney, Agent, or Firm*—Haugen Law Firm PLLP

(57) ABSTRACT

A corrosion inhibitor composition for use in combination with cathodic protection of metallic structures includes between about 5 and 80 percent by weight cyclohexylammonium benzoate; between about 1 and 10 percent by weight monoethanolammonium benzoate; between about 5 and 90 percent by weight dicyclohexylammonium nitrate; and up to about 5 percent by weight fumed silica, and may further include about 2 percent by weight tolyltriazole.

5 Claims, No Drawings

CORROSION INHIBITOR MATERIALS FOR USE IN COMBINATION WITH CATHODIC PROTECTORS IN METALLIC STRUCTURES

FIELD OF THE INVENTION

The present invention relates to vapor phase corrosion inhibitor compositions generally, and more particularly to vapor phase corrosion inhibitor compositions that are specifically formulated to provide corrosion inhibiting properties operable in combination with cathodic protection of metallic structures.

BACKGROUND OF THE INVENTION

Storage tank bottoms, particularly those in the oil and petroleum industries, are continuously threatened by corrosive species and moisture present in the environment. When located near a body of salt water, the exposure to saline heightens this problem. Storage tanks and base supports are exposed to exceptionally high loads. For safety and environmental reasons, it is imperative that these base supports and tank bottoms remain safe, secure, and intact, and unimpaired by corrosion.

In the past, minor leakage from a storage tank was an acceptable practice. Current environmental regulations and accepted practices, however, make leakage a matter of great concern. Vast amounts of groundwater can be contaminated, and cleanup costs can be prohibitively expensive. Also, leaking tanks can make a site not saleable on the open market, and may jeopardize the positive public image of a company.

Storage tank bottoms are commonly protected from corrosion using cathodic protection (CP). One type of cathodic protection common in the art is the use of a sacrificial anode. If two dissimilar metals (electrodes) such as a zinc sacrificial anode and a steel storage tank, are immersed in a conductive liquid (electrolyte) and a voltmeter is placed between them, an electrical potential difference between these electrodes will be measured. In this particular cell, the less noble metal, zinc, is called the sacrificial anode, and the more noble metal, steel, is called the cathode. The current causes electrochemical reactions to take place around the anode as well as around the cathode. The anode (zinc) slowly dissolves in the electrolyte, such as water, while protecting the cathode from such corrosion.

Another type of cathodic protection commonly employed in the art is that of an impressed current. In this case, a current is supplied to the tank from an external direct current source. The amount of current provided via this method can be much greater than that obtained using a sacrificial anode.

In both types of cathodic protection the current is generally delivered to the storage tank via the base support.

However, problems can occur where the storage tank is not in complete contact with the base support. This can occur, for example, when the storage tank is being filled and emptied, causing the bottom of the storage tank to buckle slightly, leaving air gaps. Other times, a portion of the base support may erode. In such cases, electrical conductivity is lost between the storage tank and base support, compromising the corrosion resistance provided by cathodic protection.

Newer storage tanks are designed with secondary containment such as double bottoms that detect leaks and contain product migration in the event of a leak. Even with such systems in place, corrosion protection must still be addressed to minimize the occurrence of leaks.

The problems that arise when there is not complete contact between the storage tank and base support can be controlled with the proper use of vapor phase corrosion inhibitors (VpCI). Various compositions of these inhibitors are known to provide corrosion protection under wet conditions, corrosive environments and in void spaces, as experienced in a storage tank and base support arrangement. Unfortunately, exposure to cathodic protection can adversely affect the performance of many VpCI compositions. For example, some VpCI compositions lose effectiveness or even enhance corrosion when exposed to a cathodic environment.

It would, therefore, be advantageous to provide one or more VpCI compositions that are effective both independently and in the presence of cathodic protection.

SUMMARY OF THE INVENTION

The present invention provides selected VpCI compositions that can be used individually or in combination with cathodic protection of metallic structures. The present invention is suitable especially for the protection of a storage tank and/or base support. Typically, storage tanks are mounted on base supports of sand or concrete. Both of these base support materials are suitable for adding VpCI chemicals as a measure of corrosion protection.

The VpCI compositions of the present invention were tested in combination with cathodic protection to ensure that the VpCI compositions are effective in such an environment. The VpCI compositions described herein are capable of providing added protection against corrosion when used in a cathodic protection environment.

Preferably, the VpCI composition is in a powder form, adapted to be dissolved in an aqueous solution.

DETAILED DESCRIPTION OF THE PREFERRED EMBODIMENTS

The objects and advantages enumerated above together with other objects, features and advances represented by the present invention will now be presented in terms of the detailed embodiments. Other embodiments and aspects of the invention are recognized as being within the grasp of those having ordinary skill in the art.

Example 1

A selected powder mix of a VpCI chemical composition is produced from the following chemicals:

| Component | Percent by weight |
|---|---|
| Cyclohexylammonium benzoate | 70 |
| Monoethanolammonium benzoate | 6 |
| Dicyclohexylammonium benzoate | 19 |
| Fumed silica | 5 |

Example 2

Another selected powder mix of a VpCI chemical composition is produced from the following chemicals:

| Component | Percent by weight |
|---|---|
| Cyclohexylammonium benzoate | 70 |
| Monoethanolammonium benzoate | 6 |
| Dicyclohexylammonium benzoate | 19 |
| Fumed silica | 3 |
| Tolyltriazole | 2 |

Example 3

A selected powder mix of a VpCI chemical composition is produced from the following chemicals:

| Component | Percent by weight |
|---|---|
| Cyclohexylammonium benzoate | 7 |
| Monoethanolammonium benzoate | 1 |
| Dicyclohexylammonium benzoate | 87 |
| Fumed silica | 4 |

Example 4

A selected powder mix of a VpCI chemical composition is produced from the following chemicals:

| Component | Percent by weight |
|---|---|
| Cyclohexylammonium benzoate | 78 |
| Monoethanolammonium benzoate | 9 |
| Dicyclohexylammonium benzoate | 8 |
| Fumed silica | 5 |

The performance of the VpCI powders was evaluated in a cathodic protection environment. Cathodic protection of steel can be performed by utilizing sacrificial anodes, such as anodes to steel metals (Zinc, Magnesium, Aluminum and their alloys), or using impressed-current anodes.

To evaluate the performance of VpCI powders in combination with a Zinc sacrificial anode (Zn), a half immersion corrosion test was carried out by connecting Carbon Steel (CS) and Zinc (Zn) panels with an electrical wire and partially immersing them in a test solution for five days at room temperature. After testing, panels were visually examined for the presence of corrosion.

Tap water was used as a control test solution for comparison to 0.5% VpCI solutions by weight for each example.

TABLE 1

Results of solution immersion test.

| Material | Presence of corrosion on CS | Presence of corrosion on Zn |
|---|---|---|
| Example 1 - 0.5% | No visible corrosion | Slight corrosion |
| Example 2 - 0.5% | No visible corrosion | Very slight corrosion |

TABLE 1-continued

Results of solution immersion test.

| Material | Presence of corrosion on CS | Presence of corrosion on Zn |
|---|---|---|
| Example 3 - 0.5% | No visible corrosion | Very slight corrosion |
| Example 4 - 0.5% | No visible corrosion | Very slight corrosion |
| Control (Tap Water) | No visible corrosion | Corrosion |

As seen from the results in Table 1, the VpCI powders of the present invention exhibited enhanced corrosion inhibition relative to the control. Such a result is important in that conventional chemical VpCI materials have been ineffective in a cathodic protection environment.

A sand immersion corrosion test was carried out by connecting Carbon Steel and Zinc panels with an electrical wire and partially immersing them in sand. The sand was treated with test solutions and the panels were visually inspected for corrosion at one day and ten days. A 1% NaCl solution was used as a control for comparison to 1% VpCI solutions of each example.

TABLE 2

Results of sand immersion test.

| Material | Carbon Steel (1 day) | Zinc (1 day) | Carbon Steel (1 day) | Zinc (10 days) |
|---|---|---|---|---|
| Example 1 - 1% | No corrosion | Corrosion | No corrosion | Corrosion |
| Example 2 - 1% | Very slight corrosion | Corrosion | Corrosion | Corrosion |
| Example 3 - 1% | No corrosion | Corrosion | No corrosion | Corrosion |
| Example 4 - 1% | No corrosion | Corrosion | No corrosion | Corrosion |
| Control (1% NaCl) | Start of corrosion | Corrosion | Corrosion | Corrosion |

As seen from the results in Table 2, the VpCI powders inhibited corrosion relative to the control.

To evaluate the performance of VpCI powders in combination with cathodic protection provided by impressed current anodes, a cathodic potential of −900 mV using a Calomel Saturated Electrode was applied to the Carbon Steel electrode, and the current to support this potential was measured.

Testing was conducted using an electrolyte without an inhibitor, a 3% by weight NaCl solution, as a control. The VpCI powders were tested by adding the VpCI powder to be tested to the solution at a concentration of 0.5% by weight VpCI. If the level of current in the solution containing the VpCI is equal to or lower than the control, the VpCI powder provides corrosion resistance in the presence of a cathodic protection environment.

TABLE 3

Performance of VpCI powders in combination with cathodic protection provided by impressed current anodes.

| Material | Current at −900 mV |
|---|---|
| Example 1 - 0.5% solution | 22.9 |
| Example 2 - 0.5% solution | 23.0 |
| Example 3 - 0.5% solution | 22.0 |
| Example 4 - 0.5% solution | 23.0 |
| Control (3% NaCl solution) | 27.2 |

As indicated above, the examples showed a current lower than that of the control, indicating that the VpCI compositions are able to significantly inhibit corrosion in the presence of cathodic protection.

The compositions described in the above examples provided corrosion resistance in accordance with the above test methods. In use, the VpCI compositions of the present invention may be added to the sand or concrete base support on which a storage tank is positioned. The VpCI can be applied directly to the sand or concrete base or can be intermixed mechanically during the formation of the base support, utilizing traditional hand tools. The VpCI slowly migrates throughout the base to provide protection of the storage tank against corrosion.

The invention has been described herein in considerable detail in order to comply with patent statutes, and to provide those skilled in the art with the information needed to apply the novel principles to construct and use the embodiments of the invention as required. However, it is to be understood that various modifications can be accomplished without departing from the scope and spirit of the invention itself.

What is claimed is:

1. A method for protecting metallic structures from corrosion, said method comprising:

(a) providing a sacrificial anode appropriate for said metallic structure;

(b) positioning said sacrificial anode in electrical conduction with said metallic structure;

(c) providing a corrosion inhibitor composition having:

(i) about 5 to about 80 percent by weight cyclohexylammonium benzoate;

(ii) about 1 to about 10 percent by weight monoethanolammonium benzoate;

(iii) about 5 to about 90 percent by weight dicyclohexylammonium nitrate; and (iv) up to about 5 percent by weight fumed silica; and (d) applying said corrosion inhibitor composition to or adjacent to said metallic structure.

2. A method for inhibiting corrosion of cathodically-protected metallic structures, said method comprising:

(a) providing a corrosion inhibitor composition comprising:

(i) about 5 to about 80% by weight cyclohexylammonium benzoate;

(ii) about 1 to about 10% by weight monoethanolammonium benzoate;

(iii) about 5 to about 90% by weight dicyclohexylammonium nitrate; and (iv) up to about 5% by weight fumed silica; and (b) applying said corrosion inhibitor composition to or adjacent to said metallic structures.

3. A method as in claim 2 wherein said corrosion inhibitor composition further comprises about 2% by weight tolyltriazole.

4. A method as in claim 2 wherein said corrosion inhibitor composition comprises:

(a) about 70% by weight cyclohexylammonium benzoate;

(b) about 6% by weight monoethanolammonium benzoate;

(c) about 19% by weight dicyclohexylammonium nitrate; and (d) about 5% by weight fumed silica.

5. A method as in claim 2 wherein said corrosion inhibitor composition is a water soluble powder.

* * * * *